US006588467B2

(12) United States Patent
Havumaki et al.

(10) Patent No.: US 6,588,467 B2
(45) Date of Patent: Jul. 8, 2003

(54) ARRANGEMENT IN THE DISCHARGE END OF A DEBARKING MACHINE

(75) Inventors: Jouni Havumaki, Vaaksy (FI); Pekka Kokko, Hollola (FI); Bruce Kirkpatrick, Lachine (CA)

(73) Assignee: Andritz Oy, Hollola (FI)

( * ) Notice: Subject to any disclaimer, the term of this patent is extended or adjusted under 35 U.S.C. 154(b) by 0 days.

(21) Appl. No.: 10/121,098

(22) Filed: Apr. 11, 2002

(65) Prior Publication Data

US 2002/0170626 A1 Nov. 21, 2002

Related U.S. Application Data

(60) Provisional application No. 60/283,706, filed on Apr. 13, 2001.

(51) Int. Cl.[7] ..... B27L 1/02

(52) U.S. Cl. ..... 144/208.9; 144/208.1; 144/246.1; 144/341; 198/780

(58) Field of Search ..... 198/780, 783, 198/624; 144/208.1, 208.9, 242.1, 246.1, 341

(56) References Cited

U.S. PATENT DOCUMENTS

| | | | | | |
|---|---|---|---|---|---|
| 2,647,548 | A | * | 8/1953 | Guettler | 144/208.9 |
| 3,215,176 | A | * | 11/1965 | Ferrabee | 144/208.9 |
| 3,228,440 | A | | 1/1966 | Ferrabee | 144/208.9 |
| 4,374,533 | A | * | 2/1983 | Svensson | 144/208.9 |
| 4,685,498 | A | * | 8/1987 | Nakajima | 144/208.9 |
| 4,774,987 | A | * | 10/1988 | Sepling | 144/208.9 |
| 5,394,912 | A | | 3/1995 | Hume | 144/208 |
| 5,630,453 | A | * | 5/1997 | Ishizawa | 144/208.9 |
| 5,699,843 | A | * | 12/1997 | Gagne | 144/208.9 |

FOREIGN PATENT DOCUMENTS

| | | |
|---|---|---|
| FI | 751683 | 12/1976 |
| FI | 852752 | 1/1986 |

OTHER PUBLICATIONS

International Search Report corresponding to International Application No. PCT/FI02/00123 dated Jun. 27, 2002.

* cited by examiner

*Primary Examiner*—W. Donald Bray
(74) *Attorney, Agent, or Firm*—Alix, Yale & Ristas, LLP

(57) ABSTRACT

The invention relates to an arrangement at the discharge end of a debarking machine (12) for the preliminary debarking of logs (2) prior to a separately performed final barking and for the expulsion of at least some of the removed barks from a wood flow passing through the debarking machine. The debarking machine (1) has its discharge side provided with an extension (5), continuing from the lower section level of the support surface of the debarking machine used for bearing the logs (2), and guiding the logs (2) discharging out of the debarking machine (1). The extension may include a variable speed conveyor (7), varying the speed of which influences the admission rate of logs into the debarking machine and the dwell time of logs therein.

13 Claims, 2 Drawing Sheets

ARRANGEMENT IN THE DISCHARGE END OF A DEBARKING MACHINE

CROSS REFERENCE TO RELATED APPLICATION

This application claims the benefit of U.S. Provisional Application No. 60/283,706, filed Apr. 13, 2001.

BACKGROUND OF THE INVENTION

1. Field of the Invention

The invention relates to an arrangement at the discharge end of a debarking machine intended for the preliminary debarking of logs prior to a separately performed final barking, and more particularly to an arrangement at the discharge end which incorporates a conveyor for facilitating and regulating the discharge of logs from the debarking machine.

2. Description of the Related Art

Related debarking machines are described in U.S. Pat. Nos. 4,685,498 and 5,394,912. In these and other known debarking machines, the discharge end is usually provided with a fixed threshold or a vertically adjustable discharge gate for regulating the discharge of logs from the debarking machine. The discharge gate and the fixed threshold impede free movement of logs in the rolling direction of logs, which results in needless rounding of log ends and frequent snapping of logs. The discharge gate and the fixed threshold are also likely to cause obstructions and capacity fluctuations in a debarking machine. In addition, the discharge gate and threshold must be generally followed by a distinct drop, which increases the height of an entire assembly.

SUMMARY OF THE INVENTION

To eliminate these drawbacks, in accordance with the present invention the discharge end of a debarking machine is provided with an extension continuing from a lower level of a chute defined by the support surfaces of the debarking machine. The extension is used for bearing and guiding the logs discharging out of the debarking machine.

To promote reliable operation of a debarking machine it is important that, in terms of its orientation and shape, the support surface of the extension be such that it allows a free movement for logs downstream of the debarking machine. In one preferred embodiment of the invention, this is accomplished by arranging the support surface of the extension to be at least roughly parallel to the direction of log movement through the debarking machine. The extension may be configured as a solid support surface adapted only to guide logs discharging from the debarking machine. In such a configuration, the extension has little or no role in controlling the operation of a debarking machine.

However, in preferred embodiments of the invention, wherein the extension is provided with a conveyor or the extension is constituted by a conveyor, the extension also performs a significant function in controlling the debarking machine. This control function becomes particularly conspicuous when the conveyor is adapted to be variable in terms of its speed. At its simplest, the control of discharge rate can be a mere switch for switching the conveyor on or off. Thus, the conveyor can be used for regulating the operation of a debarking machine by discouraging or encouraging the discharge of logs. This is a way of influencing the rate of log admission into the debarking machine and the dwell time of logs in the debarking machine.

In yet another preferred application of the invention, the arrangement is such that the support surface of the extension has a cross-sectional width that is substantially equal to the width of the chute adjacent the extension.

A debarking machine in accordance with the present invention may also be described as a debarking station in the path of a wood flow. Wood support surfaces extend above the discharge conveyor to form a discharge chute for supporting logs being discharged from the debarking station. The discharge chute and the debarking station have a similar cross-sectional shape and are aligned such that logs leaving the debarking station are longitudinally aligned with the discharge conveyor. The arrangement at the discharge end of a debarking machine helps move logs through the debarking station in a controlled manner.

BRIEF DESCRIPTION OF THE DRAWINGS

The invention will now be described in more detail with reference to the accompanying drawings, in which.

DETAILED DESCRIPTION OF THE PREFERRED EMBODIMENT

Figure 2:
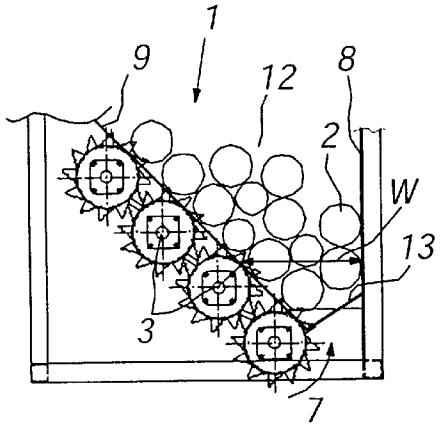
FIG. 2 is a sectional view of the debarking machine of FIG. 1 taken along line 2—2 thereof.
Figure 1:
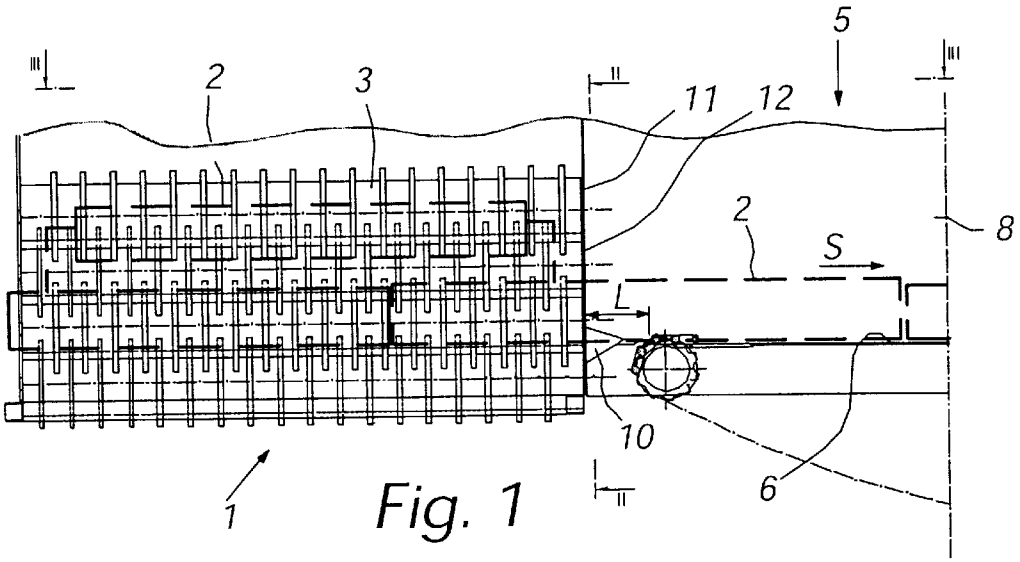
FIG. 1 is a schematic side view of a junction between a debarking machine and an arrangement at the discharge end in accordance with the present invention.
Figure 3:
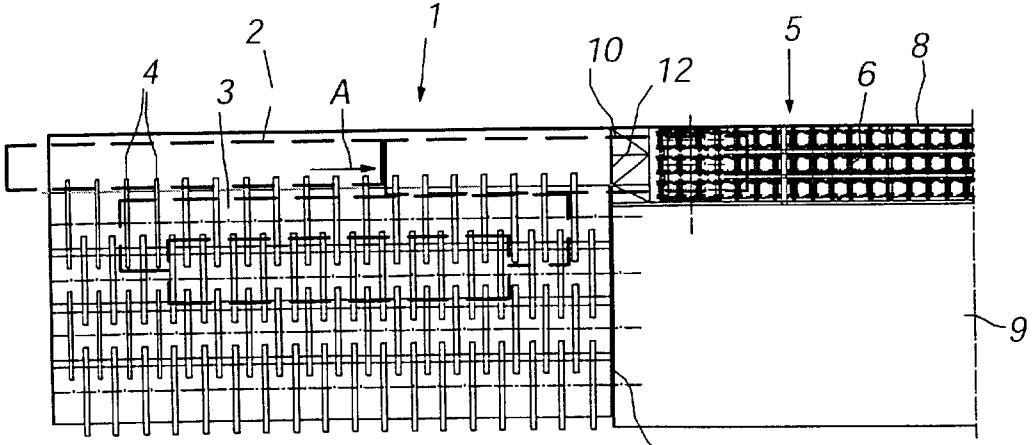
FIG. 3 is a top view of the debarking machine and arrangement at the discharge end shown in FIG. 1.

FIGS. 1–3 illustrate a debarking machine 1 intended for the preliminary debarking of logs 2 before a separately performed final barking and for the expulsion of at least some of the removed bark from a wood flow passing through the debarking machine. The debarking machine 1 is provided with a number of debarking shafts 3, extending parallel to an advancing direction A of the logs 2 to be fed therethrough and rotatable in the direction of an arrow 7 by means of a motor and drive elements (not shown). The debarking shafts 3 are provided with a number of radially projecting teeth 4 which are adapted to strip bark off the logs 2 transversely to the lengthwise direction of the logs.

Rotation of the debarking shafts 3 also causes the logs to move transversely relative to the debarking shafts 3, or up the inclined plane formed by the shafts 3 and the support surface 9. The logs 2 are held against the shafts and teeth 4 by gravity and the weight of other logs. Logs 2 in the debarking machine 1 circulate up the inclined plane formed by the shafts 3 and tumble back down the inclined plane on top of other logs.

The debarking shafts 3, together with the teeth 4 thereof, constitute a part of a support surface for carrying the logs 2 to be processed through the debarking machine 1. FIGS. 1–3 show an example with four debarking shafts 3, which are arranged relative to each other for an inclined plane. The support surfaces are solid surfaces, which are designed to form, together with the support surface constituted by the debarking shafts 3, a chute extending the length of the debarking machine 1. The chute may have an open top or it may be covered.

The debarking machine 1 has its discharge end 11 provided with an extension, generally designated with reference numeral 5, continuing from the lower portion of the chute of the debarking machine. The extension 5 supports and guides the logs 2 discharging out of the debarking machine 1. In the illustrated example, the extension 5 has its support surface for guiding the logs 2 arranged to be at least substantially parallel to the direction of log progress A through the debarking machine 1. In the illustrated embodiment, the support surface of the extension 5 is constituted by a conveyor 6 and by side panels enclosing the same and designated with reference numerals 8 and 9, as well as by a guide element 10 fitted between the conveyor 6 and the debarking machine 1. The conveyor 6 is provided with per se known elements (not shown) for regulating the conveyor speed.

The debarking machine 1 has its discharge end 11 provided with an opening 12 which is configured substantially equal to the size and shape of a chute formed by the support surfaces present in the debarking machine 1. In particular, the opening 12 has a width W equal to the width of the chute at the height of the extension 5. The support surface of the extension 5 has a width substantially equal to the width W of the chute and exit opening 12 at the height where logs exit the debarking machine 1.

The guide element 10 for guiding the logs 2 discharging from the debarking machine 1 has a length L that is preferably less than the average length of the logs 2 to be treated in the debarking machine 1. Downstream of the extension 5, the logs 2 have a totally clear passage for further treatment.

Figure 4:
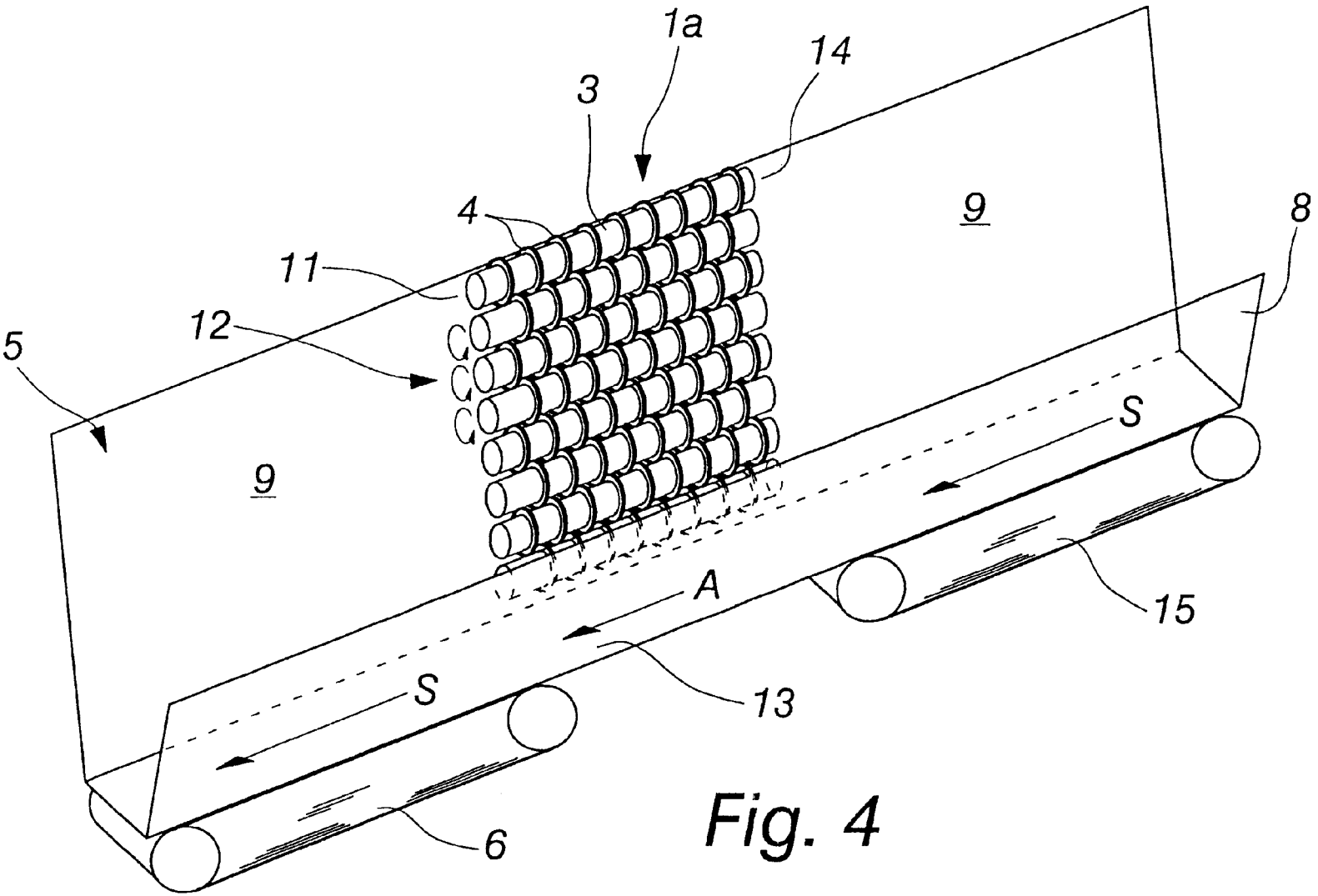
FIG. 4 is an overhead perspective view of one possible arrangement of a debarking machine equipped with input and output conveyors and arranged as a continuous trough in accordance with the present invention.

FIG. 4 is an overhead perspective view of one possible debarking machine 1*a* in accordance with the present invention. The debarking machine 1*a* is configured as an open-ended trough defined by the inclined plane of the debarking shafts 3, the bottom plate 13 and side panel 8. The debarking machine 1*a* is positioned between a feed conveyor 15 and a discharge conveyor 6. Both conveyors 6, 15 are configured to move logs in direction S which coincides with the direction A of wood movement through the debarking machine 1*a*. Side panels 8, 9 extending above the conveyors 6, 15 are essentially extensions of the chute formed by the support surfaces of the debarking machine 1*a*. Logs fed by conveyor 15 are preliminarily debarked as they pass through the debarking machine 1*a*. The extent of this preliminary debarking is dependant upon the dwell time of logs in the debarking machine 1*a*. Dwell time is controlled by the feed rates of the conveyors 6, 15 as discussed above.

From FIG. 4, it can be seen that opening 12 in the discharge end 11 of the debarking machine 1*a* is formed by the absence of a discharge gate or end wall. The discharge conveyor 6 and support surfaces 8, 9 are aligned with the feed conveyor 15 and debarking machine 1*a* to permit free flow of logs through the debarking machine 1*a*. The dwell time of logs in the debarking machine 1*a* of FIG. 4 is dependant upon the speed of conveyors 15 and 6.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An arrangement at the discharge end of a debarking machine, said debarking machine being intended for the decortication or pretreatment of logs for separately performed final barking and for the expulsion of at least some of the removed barks from a wood flow passing through the debarking machine, said debarking machine comprising a number of rotatable debarking shafts extending parallel to an advancing direction (A) of the logs to be fed therethrough and provided with a number of teeth extending beyond the circumferential surface of the shaft and adapted to strip bark off the presently processed logs transversely to the lengthwise direction of the logs and at the same to convey the log transversely relative to said shafts, and said shafts, together with the teeth thereof, being adapted to constitute at least a part of a support surface, upon which the presently processed logs travel through the debarking machine, characterized in that the debarking machine has its discharge side provided with an extension, continuing from a lower section level of the support surface of the debarking machine, said extension bearing and guiding the logs discharging out of the debarking machine, which extension comprises a powered conveyor at least substantially parallel to the support surface of the debarking machine used for guiding the logs.

2. An arrangement as set forth in claim 1, characterized in that the conveyor is a variable speed conveyor.

3. An arrangement as set forth in claim 1, characterized in that the extension (5) is constituted by a conveyor (6).

4. An arrangement as set forth in claim 1, characterized in that the support surface of the extension for guiding the logs has a cross-section which is adapted to be, at least in its lower part, substantially consistent with the cross-section of the support surface of the debarking machine used for guiding the logs.

5. An arrangement at the discharge end of a debarking machine, said debarking machine being intended for the decortication or pretreatment of logs for separately performed final barking and for the expulsion of at least some of the removed barks from a wood flow passing through the debarking machine, said debarking machine comprising a number of rotatable debarking shafts extending parallel to an advancing direction (A) of the logs to be fed therethrough and provided with a number of teeth extending beyond the circumferential surface of the shaft and adapted to strip bark off the presently processed logs transversely to the lengthwise direction of the logs and at the same to convey the log transversely relative to said shafts, and said shafts, together with the teeth thereof, being adapted to constitute at least a part of a support surface, upon which the presently processed logs travel through the debarking machine, characterized in that the debarking machine has its discharge side provided with an extension comprising a powered conveyor, continuing from a lower section level of the support surface of the debarking machine used for bearing the logs, and guiding the logs discharging out of the debarking machine, which extension has a support surface for guiding the logs adapted to be at least substantially parallel to the support surface of the debarking machine used for guiding the logs, wherein the conveyor is adapted to be variable in terms of its speed.

6. A debarking machine for removing bark from logs advancing through the machine toward a discharge end in a first direction, said debarking machine comprising:

a plurality of debarking shafts extending substantially parallel to said first direction, each said shaft having a plurality of radially projecting teeth, said shafts comprising at least part of a of a support surface upon which the logs are supported;

a chute defined by the support surface including said shafts; and an extension comprising a discharge support surface for supporting and guiding logs discharging from the discharge end, said discharge support surface being substantially parallel to and extending from a lower portion of said chute.

7. The debarking machine of claim 6, wherein said extension includes a conveyor.

8. The debarking machine of claim 6, wherein said discharge surface comprises a conveyor.

9. The debarking machine of claim 7, wherein said conveyor is a variable speed conveyor.

10. The debarking machine of claim 6, wherein the discharge surface and the lower portion of said chute have a substantially equivalent width measured transverse to the first direction.

11. A debarking station for debarking logs, said station comprising:

a longitudinally extending open ended debarking trough wherein at least part of the debarking trough is defined by a plurality of longitudinally extending rotatable debarking shafts, each debarking shaft equipped with a plurality of radially projecting teeth;

a discharge conveyor substantially parallel to said debarking trough and arranged to extract logs emerging from a discharge end of said debarking trough.

12. The debarking station of claim 11, wherein the discharge conveyor is equipped with side panels to form a discharge trough having substantially the same cross sectional configuration as the debarking trough.

13. The debarking station of claim 11, wherein an admission end of the debarking station is provided with a feed conveyor equipped with side panels to form a feed chute having substantially the same cross sectional configuration as the debarking trough.

* * * * *